US006659914B2

(12) United States Patent
Plante

(10) Patent No.: US 6,659,914 B2
(45) Date of Patent: Dec. 9, 2003

(54) SPRINGLESS BOUNCE APPARATUS

(75) Inventor: Thomas M. Plante, Woodbury, MN (US)

(73) Assignee: Rave Sports Inc., St. Paul, MN (US)

( * ) Notice: Subject to any disclaimer, the term of this patent is extended or adjusted under 35 U.S.C. 154(b) by 25 days.

(21) Appl. No.: 10/033,344

(22) Filed: Dec. 27, 2001

(65) Prior Publication Data

US 2003/0125163 A1 Jul. 3, 2003

(51) Int. Cl.[7] ..... A63B 5/11; B63B 35/58
(52) U.S. Cl. ..... 482/27; 441/40
(58) Field of Search ..... 482/27–29, 35–36; 441/40–4; 5/655.3, 413 AM

(56) References Cited

U.S. PATENT DOCUMENTS

| | | | | |
|---|---|---|---|---|
| 1,456,168 A | | 5/1923 | Witmer et al. | |
| 3,095,947 A | | 7/1963 | Beaulaurier | 182/139 |
| 4,331,329 A | | 5/1982 | Mirkovich et al. | |
| 4,478,420 A | * | 10/1984 | Sowards | 473/435 |
| 4,576,375 A | | 3/1986 | Roberts | |
| 5,299,989 A | | 4/1994 | Boyd et al. | 482/27 |
| 5,385,518 A | * | 1/1995 | Turner | 482/27 |
| 5,810,695 A | | 9/1998 | Sass | 482/27 |
| 5,967,943 A | | 10/1999 | Rich | 482/27 |
| 6,036,620 A | | 3/2000 | Yang | 482/27 |
| 6,582,264 B2 | * | 6/2003 | Brown | 441/40 |

OTHER PUBLICATIONS

Jump 'N Fun product literature (2 pages).
MAXXON website page, Aug. 23, 2000 (1 page).

* cited by examiner

*Primary Examiner*—Nicholas D. Lucchesi
*Assistant Examiner*—Fenn C Mathew
(74) *Attorney, Agent, or Firm*—Allison Johnson, P.A.

(57) ABSTRACT

A bounce apparatus that includes a continuous inflatable support, an apron attached to the support, the apron including a sheet having a plurality of apertures and being folded over upon itself to form a plurality of loops, a mat that includes loops, and a cord passing through the apron loops and the mat loops.

23 Claims, 7 Drawing Sheets

SPRINGLESS BOUNCE APPARATUS

BACKGROUND OF THE INVENTION

The invention relates to maintaining a mat on a bounce apparatus.

Trampolines are available in various constructions. Some trampolines include metal frames for support of the trampoline on land. Other trampolines are capable of floating on water and typically include a continuous floatable tube for supporting the trampoline. Regardless of the support configuration, the trampoline usually includes a trampoline mat attached to a metal frame through metal springs. The metal springs hold the trampoline mat taught and provide additional bounce to the user of the trampoline.

Trampolines are also constructed without springs for holding the trampoline mat. Such trampolines are referred to as "springless trampolines." One springless trampoline construction includes an inflated tube, an apron attached to the tube, individual loops of woven webbing stitched to the apron and a trampoline mat that includes individual loops of woven webbing stitched to the trampoline mat. The trampoline mat is secured to the tube by placing the trampoline mat loops and the apron loops in an alternating relationship with one another, feeding a cord through the alternating apron loops and mat loops, and tightening the cord to fix the trampoline mat in place.

SUMMARY

In one aspect, the invention features a bounce apparatus that includes a continuous inflatable support, an apron attached to the support, the apron including a sheet having a plurality of apertures, the sheet being folded over upon itself to form a plurality of loops, a mat that includes loops, and a cord passing through the apron loops and the mat loops to secure the mat to the support. In one embodiment, the cord alternately passes through an apron loop and a mat loop. In another embodiment, the apron loops interdigitate with the mat loops.

In other embodiments, the continuous inflatable support includes a tube. In one embodiment, the tube includes segments. In another embodiment, a mat loop is present at the union between two segments of the tube. In some embodiments, the apron includes a plurality of segments, at least one of the segments including a plurality of the loops. In other embodiments, the apron segments are substantially straight.

In one embodiment, adjacent apron segments are attached together to form a union. In some embodiments, a union of the apron segments extends across a union of tube segments. In other embodiments, each segment of the apron is attached to a segment of the tube.

In some embodiments, the apertures of the sheet form arcuate valleys between adjacent apron loops. In one embodiment, the arcuate valleys include elliptical arcs. In other embodiments, the apertures of the sheet are at least partially defined by substantially straight sidewalls.

In other embodiments, the continuous support defines a shape selected from the group consisting of circle, triangle, square, rectangle, hexagon, octagon and decagon.

In some embodiments the mat defines a shape selected from the group consisting of circle, triangle, square, rectangle, hexagon, octagon and decagon.

In one embodiment, the mat loops are attached near the peripheral edge of the mat.

In another embodiment, the apron includes a first material and the inflatable support includes a second material, the first material being the same as the second material. In other embodiments, the apron and the loops include a polymer impregnated woven material. In some embodiments, the apron and the loops include polymer selected from the group consisting of polyvinylchloride and polyurethane.

In another embodiment, the invention features a bounce apparatus that includes a) a continuous support defining an opening, the support including a segmented inflatable tube, b) an apron attached to the support, the apron including segments formed of a sheet having apertures, the sheet being folded over upon itself to form a plurality of loops, c) a mat extending across the opening defined by the continuous support and including loops and d) a cord passing through the apron loops and the mat loops.

In another aspect, the invention features a bounce apparatus that includes a support, an apron attached to the support and including a sheet that has apertures and that has been folded over upon itself to form a plurality of loops, a mat that includes loops, and a cord passing through the apron loops and the mat loops to secure the mat to the support. In one embodiment, the support includes a metal frame. In other embodiments the support is floatable.

The invention features a bounce apparatus that can float on water and that includes a mat on which adults and children can play, bounce, jump and rest. The bounce apparatus can be constructed to be free of rigid elements such as the metal frame and springs that are often used to hold mats in bounce apparatuses such as trampolines.

The unitary nature of the transition apron and the apron loops of the bounce apparatus provide a unique mechanism for attaching the mat to the support. The apron enables the mat to experience a uniform force along its perimeter that allows the mat to lie flat without wrinkles or bulges.

The unitary apron and apron loop construction also enables the formation of a number of loops in a single welding operation, which reduces the number of manufacturing steps required to produce each loop relative to a process that requires each loop to be individually stitched to the apron. The use of substantially straight apron segments provides a smooth array of apron loops that lie flat and do not exhibit bunching or pleating.

Other features of the invention will be apparent from the following description of preferred embodiments thereof, and from the claims.

DETAILED DESCRIPTION

Figure 1:
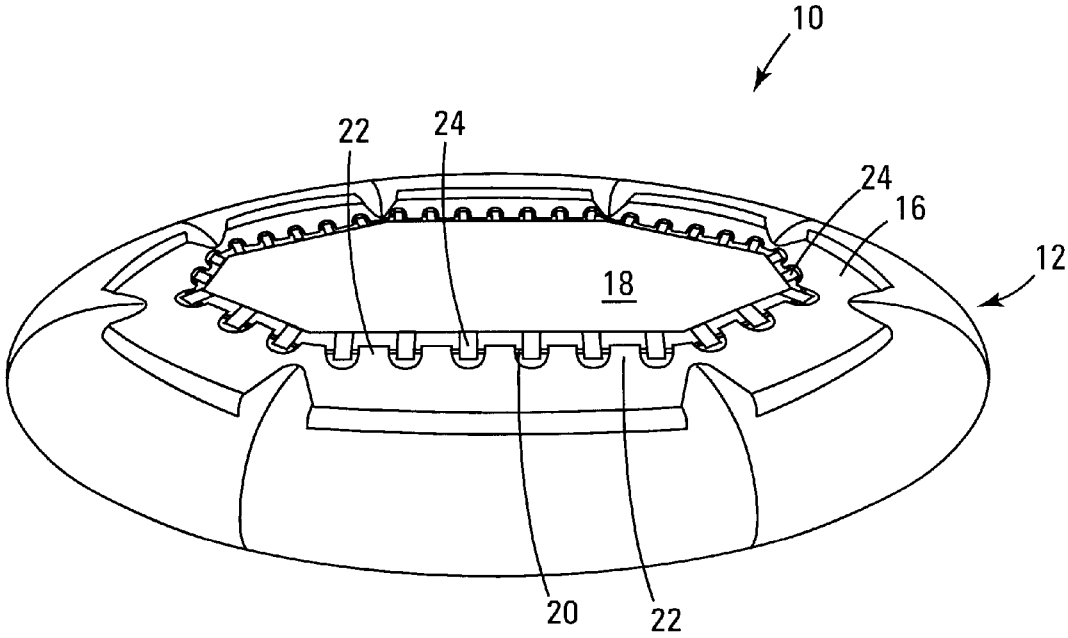
FIG. 1 is a perspective view of a bounce apparatus according to one embodiment.
Figure 2:
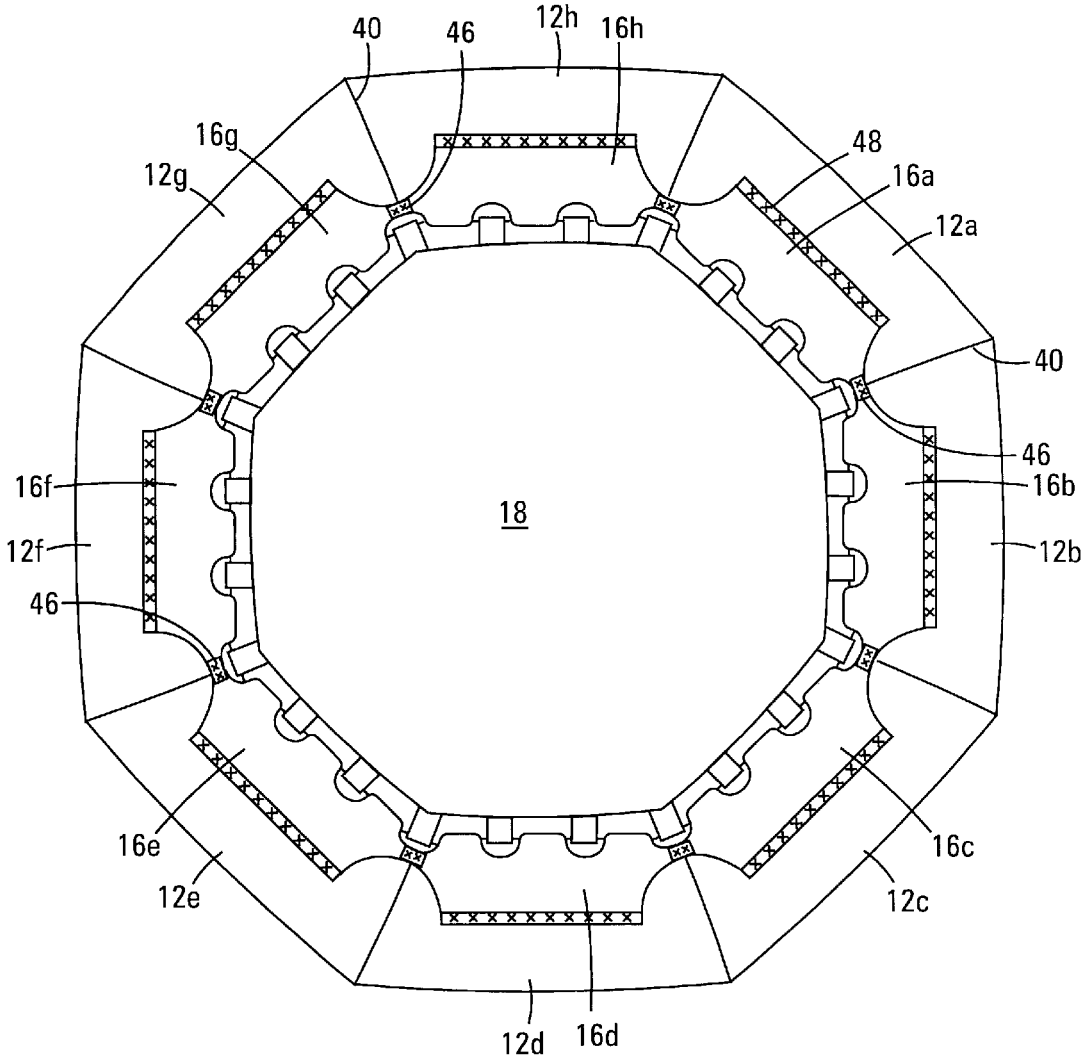
FIG. 2 is a top view of the bounce apparatus of FIG. 1.
Figure 3:
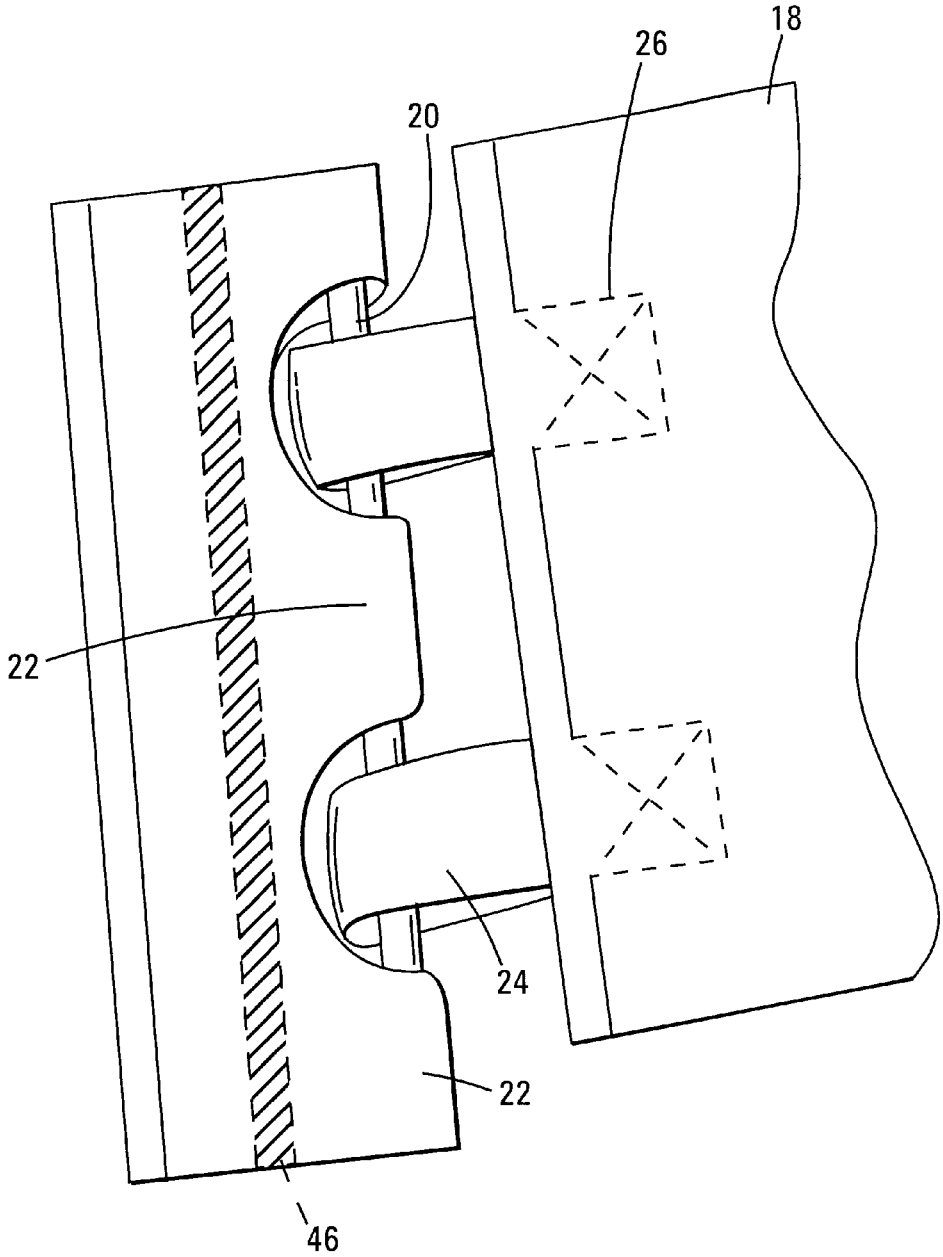
FIG. 3 is an enlarged top view of a segment of the transition apron and mat of FIG. 1.
Figure 4:
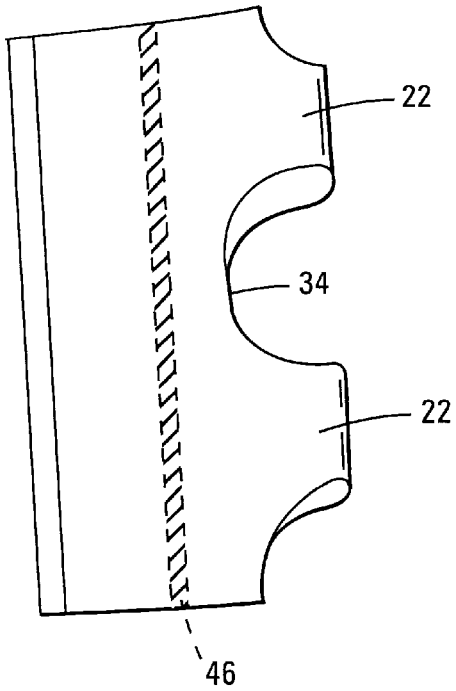
FIG. 4 is an enlarged top view of the transition apron of FIG. 1.
Figure 5:
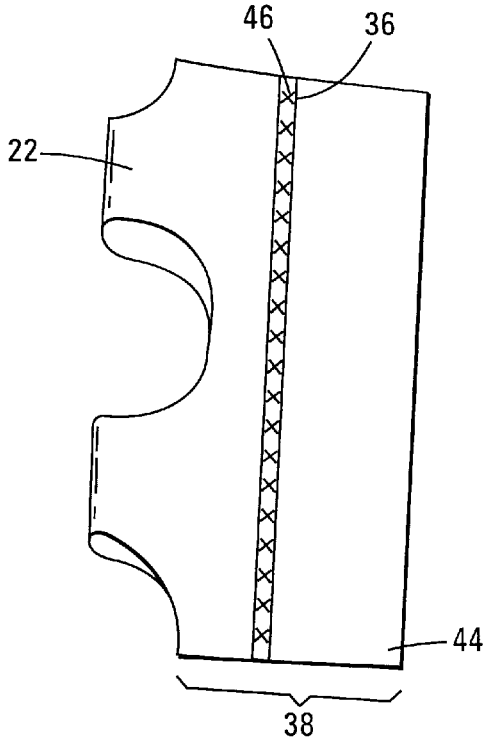
FIG. 5 is the back view of the transition apron of FIG. 4.
Figure 6:
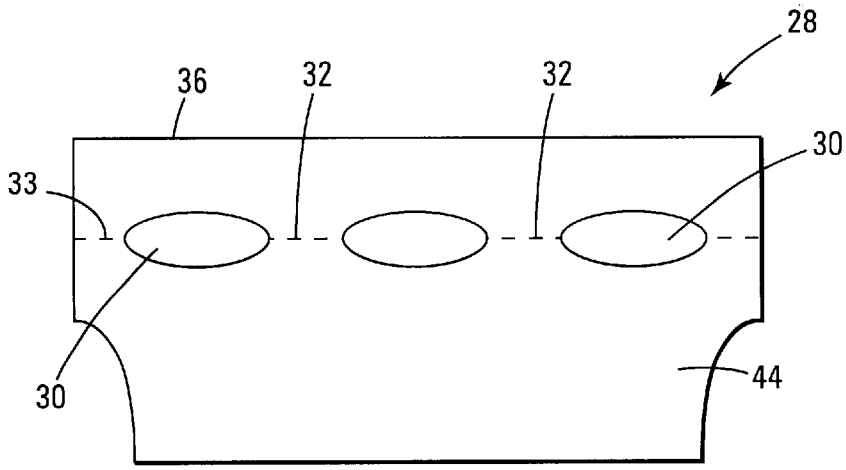
FIG. 6 is a top view of a sheet for forming the transition apron of FIG. 5.

FIGS. 1–6 illustrate a bounce apparatus 10 that includes a support 12, an apron 16 attached to a support 12, a mat 18 extending across the opening defined by the support 12, and a cord 20 that alternately passes through loops 24 extending from the mat 18 and loops 22 on the apron 16 to secure the mat to the support 12.

The support 12 is a continuous tube that includes a number of adjacent tube segments 12*a*–12*h* joined together. The continuous tube 12 includes walls extending down through the tube 12 at the union 40 of two adjacent tube segments 12*a*–12*h* to define the tube segments 12*a*–12*h* and to isolate the tube segments 12*a*–12*h* from one another. Alternatively, at least one passage can exist between at least two adjacent tube segments, e.g., to permit the flow of air there between or the continuous tube 12 can be a single continuous segment.

The apron 16 includes a number of segments 16*a*–16*h* bonded together to form a continuous apron 16. The union 46 between two apron segments is formed by overlapping a portion of two adjacent apron segments and thermally welding the segments together.

The apron segments 16*a*–*h* are constructed from a sheet 28 folded over upon itself at the fold line 33 and welded to itself (see weld 46) to form the loops 22 through which the cord 20 passes. The sheet 28 includes a number of elliptical apertures 30 spaced a distance apart from each other. The apertures can be of a variety of shapes but are preferably arcuate. When the sheet is folded over upon itself, the portions 32 of the sheet 28 that extend between two aperture 30 form the apron loops 22 and the apertures 30 form valleys 34 between the apron loops 22. The valleys 34 provide a space for receiving the loops 24 of the mat 18. The valleys 34 are preferably hemi-elliptical to facilitate even distribution of stress on the apron 16 and the apron loops 22. The leading edge 36 of the sheet 28 is welded to the interior surface 44 of the base portion 38 of the sheet 28 to fix the loops 22 in place on the apron 16.

Each apron segment 16*a*–16*h* is bonded to a corresponding tube segment 12*a*–12*h* through a weld 48. The apron segments 16*a*–16*h* are positioned on the tube segments 12*a*–12*h* such that the union 46 of two adjacent apron segments 16*a* and 16*b* corresponds to the union 40 of two adjacent tube segments 12*a* and 12*b*. The apron segments 16*a*–16*h* are dimensioned to substantially conform to the general shape defined by the tube 12, the mat 18 or a combination thereof. For example, the tube contacting edge of the apron segment preferably follows the general path, e.g., curvature, of the tube segment in the area of contact between the apron segment and the tube, and the loop containing edge preferably follows the general path of the side edge of the mat with which it is associated. For an apparatus having tube segments that are substantially straight and a mat with substantially straight sides, for example, the apron segments are preferably substantially straight. By conforming to the general path defined by the tube and the mat, the apron segments pull with a more uniform force on the mat and thereby enable the mat to be maintained generally flat, e.g., free of bulges, buckles and wrinkles.

The apron 16 and the tube 12 can be made from the same or different material. Preferably the apron and the tube are capable of being bonded to each other by welding, e.g., thermal welding, but may be attached through various other mechanisms including e.g., other bonding methods including, e.g., sonic welding, adhesive composition and combinations thereof, and mechanical methods including, e.g., stitching, stapling and mechanical fasteners including, e.g., grommets and snaps, and combinations thereof. Examples of useful apron and tube materials include thermoplastic resin impregnated woven webs including, e.g., polyvinyl or polyurethane impregnated woven webs.

The various components of the bounce apparatus have been described as being attached to each other through a weld. Alternatively, the components can be attached to each other using any suitable attachment method including, e.g., other bonding methods (e.g., sonic welding, adhesive composition and combinations thereof), mechanical methods (e.g., stitching, stapling and mechanical fasteners including, e.g., grommets and snaps), and combinations thereof.

Various materials are suitable for mat 18 including, e.g., woven webs, conventional trampoline mats and resilient webs. The mat is depicted as octagonal. Other useful mat shapes include, e.g., a circle and a polygon including, e.g., triangle, square, rectangle, hexagon and decagon.

The periphery of the mat 18 includes outwardly extending loops 24 that are attached to the mat 18 by stitching 26. Alternately, the loops can be constructed as a single unit with the mat or attached using other mechanical and adhesive bonding mechanisms. The mat loops 24 are dimensioned to be positioned within the valleys 34 between two adjacent apron loops 22 such that the mat loops 24 and the apron loops 22 interdigitate. The mat loops 24 also extend into valleys 34 positioned at the union 40 between two apron segments 16*a*–16*h*. For mats 18 having multiple straight sides, the presence of a valley 34 and a mat loop 24 at the apron union 40 enables the force on the mat 18 to be more uniformly applied to the mat 18. Useful mat loop materials include, e.g., woven webs and polymer impregnated webs.

The bounce apparatus can be constructed to be floatable on a body of water and to provide a deck surface for supporting human beings in a variety of activities including, e.g., sunning, resting, playing, and jumping.

Other embodiments are within the claims. Although the support is depicted as octagonal, it may have various shapes including, e.g., circle and polygon, e.g., triangle, square, rectangle, hexagon, and decagon. The apparatus can also include an encasement, e.g., a polyvinylchloride impregnated woven fabric, surrounding the tube 12 or tube segments.

Figure 7:
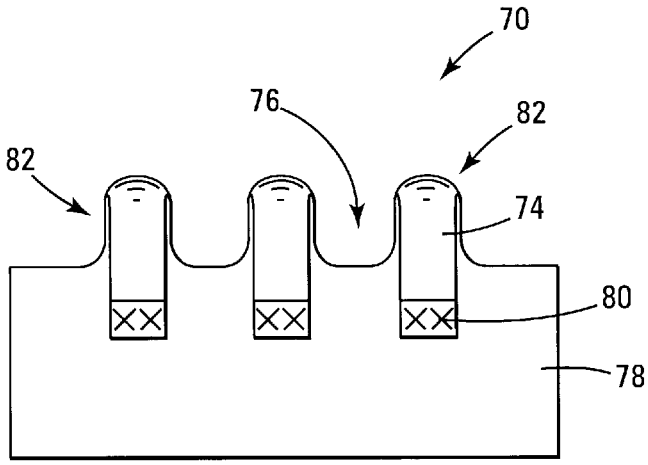
FIG. 7 is a plan view of a second embodiment of an apron.
Figure 8:
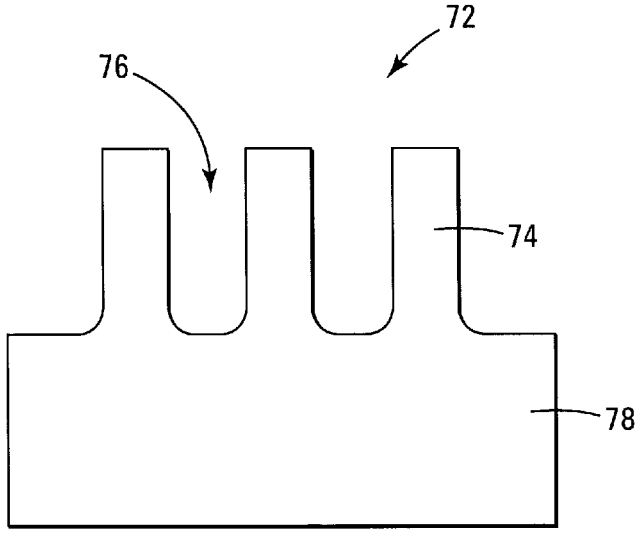
FIG. 8 is a plan view of an unfolded sheet used to form the apron of FIG. 7.

FIGS. 7 and 8 illustrate an embodiment of the apron 70 that is formed from a sheet 72 that includes individual strips 74 spaced apart from one another by longitudinal apertures 76. The strips 74 are continuous with and extend from a base portion 78 of the sheet 72. The individual strips 74 are folded over upon themselves and attached 80 to the base portion 78 of the sheet 72 to form the apron loops 82 for receiving the cord.

Figure 9:
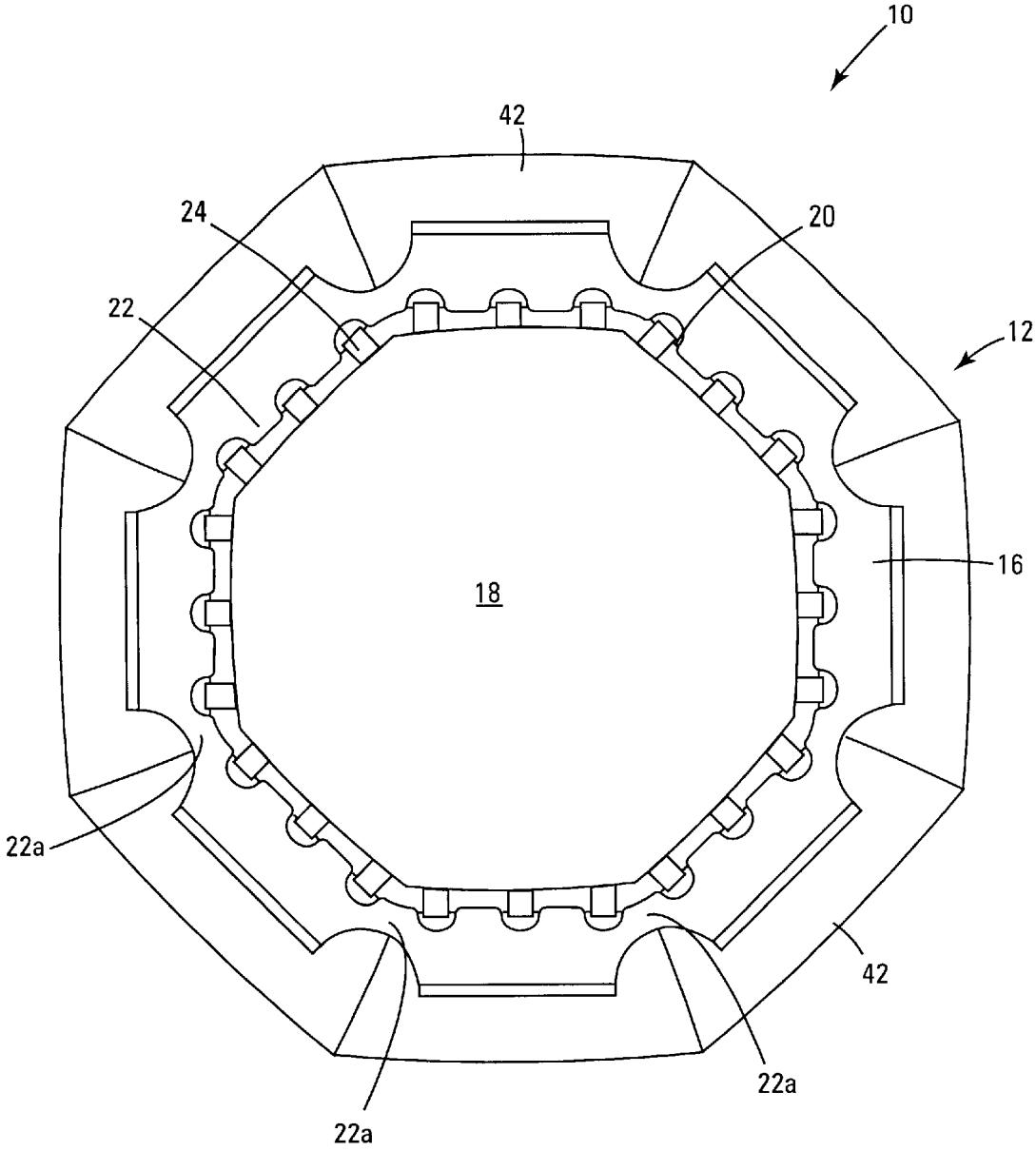
FIG. 9 is a top view of a bounce apparatus having an apron according to a third embodiment.

FIG. 9 illustrates an embodiment of the bounce apparatus 90 in which the apron 96 includes apron loops 22*a* at the union 40 of the tube segments 42*a*–42*h*.

Figure 10:
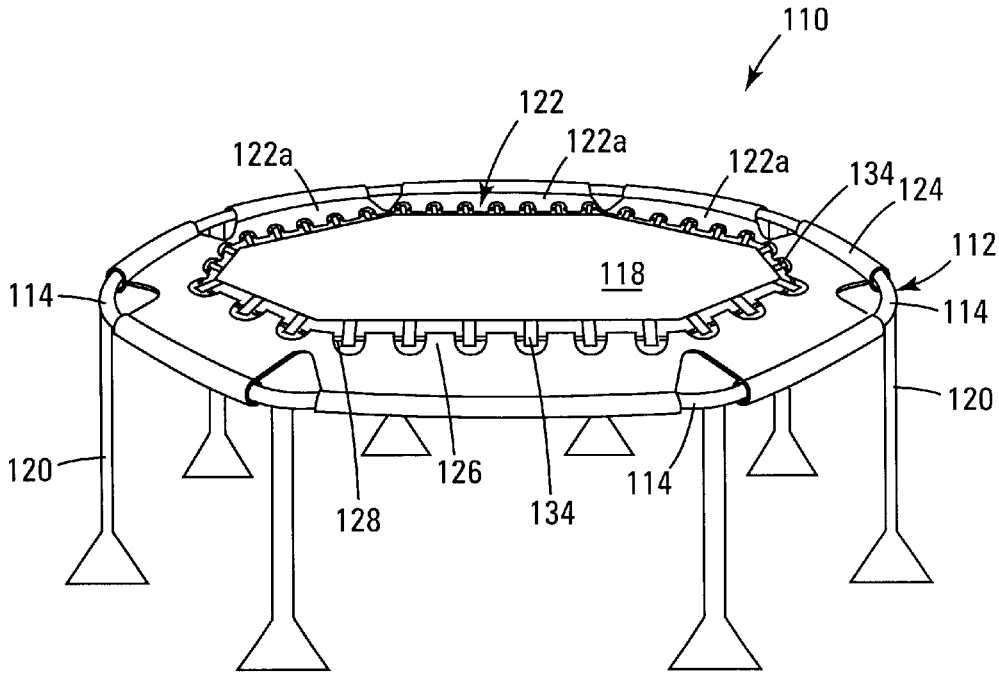
FIG. 10 is perspective view of a second embodiment of a bounce apparatus.
Figure 11:
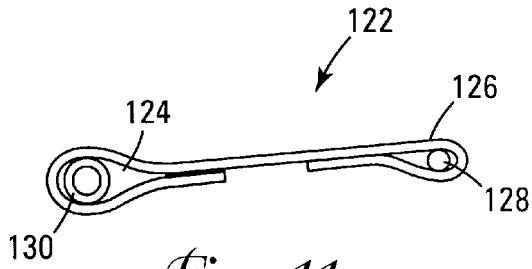
FIG. 11 is a view of the apron taken in cross section along line 1—1 of FIG. 10.
Figure 12:
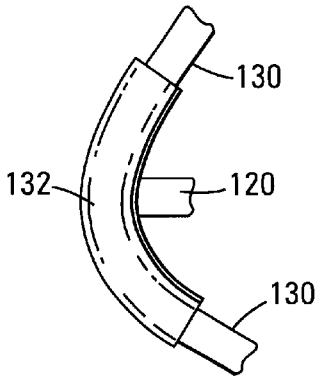
FIG. 12 is a cutaway top view of a portion of the frame of the bounce apparatus of FIG. 10.

FIGS. 10–12 illustrate an embodiment of the bounce apparatus 110 that includes a support 112 that is metal or another rigid material. The support 112 includes a frame 114 for supporting the mat 118 of the bounce apparatus 110 and legs 120 extending from the frame 114 to support the mat 118 above the surface on which the bounce apparatus 110 is positioned. An apron 122 is attached to the frame 114 through a frame-receiving passage 124. The frame-receiving passage 124 is formed by folding the fabric of the apron 122 upon itself and securing the fabric in place. The frame-receiving passage 124 is disposed at the end of the apron 122 that is opposite the end of the apron 122 that includes the loops 126 for receiving the cord 128. The apron 122 includes a number of segments 122*a* each joined together to form a continuous apron 122 and each including a frame-receiving passage 124. The frame 112 includes tubular segments 130 that pass through the frame-receiving passages 124 of the apron 122 and that are joined together through connectors 132 that are positioned in the aperture between each apron segment 122*a*. The tubular segments 130 of the frame 114 are connected to each other to form a continuous frame 114. The apron 122 is connected to the mat 118 via a cord 128 passing through loops 134 on the mat 118 and loops 126 on the apron 122 as described in previous embodiments.

What is claimed is:

1. A bounce apparatus comprising:

a continuous inflatable support;

an apron attached to said support, said apron comprising a sheet comprising a plurality of apertures, said sheet being folded over upon itself to form a plurality of loops;

a mat comprising loops; and a cord passing through said apron loops and said mat loops to maintain said mat in relation to said support.

2. The bounce apparatus of claim 1 wherein said cord alternately passes through an apron loop and a mat loop.

3. The bounce apparatus of claim 1 wherein said apron loops interdigitate with said mat loops.

4. The bounce apparatus of claim 1 wherein said continuous inflatable support comprises a tube.

5. The bounce apparatus of claim 4 wherein said tube comprises segments.

6. The bounce apparatus of claim 4 wherein a mat loop is present at the union between two segments of said tube.

7. The bounce apparatus of claim 4 wherein said apron comprises a plurality of segments, at least one of said segments comprising a plurality of said loops.

8. The bounce apparatus of claim 7 wherein said apron segments are substantially straight.

9. The bounce apparatus of claim 7 wherein adjacent apron segments are attached together to form a union.

10. The bounce apparatus of claim 7 wherein a union of said apron segments extending across a union of said tube segments.

11. The bounce apparatus of claim 7 wherein each segment of said apron is attached to a segment of said tube.

12. The bounce apparatus of claim 1 wherein said apertures of said sheet form arcuate valleys between adjacent apron loops.

13. The bounce apparatus of claim 12 wherein said arcuate valleys comprise elliptical arcs.

14. The bounce apparatus of claim 1 wherein said apertures of said sheet are at least partially defined by substantially straight sidewalls.

15. The bounce apparatus of claim 1 wherein said continuous support defines a shape selected from the group consisting of circle, triangle, square, rectangle, hexagon, octagon and decagon.

16. The bounce apparatus of claim 1 wherein said mat defines a shape selected from the group consisting of circle, triangle, square, rectangle, hexagon, octagon and decagon.

17. The bounce apparatus of claim 1 wherein said mat loops are attached near the peripheral edge of said mat.

18. The bounce apparatus of claim 1 wherein said apron comprises a first material and said inflatable support comprises a second material, said first material being the same as said second material.

19. The bounce apparatus of claim 1 wherein said apron and said loops comprise a polymer impregnated woven material.

20. The bounce apparatus of claim 1 wherein said apron and said loops comprise polymer selected from the group consisting of polyvinylchloride and polyurethane.

21. A bounce apparatus comprising:

a) a continuous support defining an opening, said support comprising a segmented inflatable tube;

b) an apron attached to said support, said apron comprising segments comprising a sheet having apertures, said sheet being folded over upon itself to form a plurality of loops;

c) a mat extending across said opening, said mat comprising loops; and d) a cord passing through said apron loops and said mat loops.

22. A bounce apparatus comprising:

a support;

an apron attached to said support, said apron comprising a sheet comprising apertures, said sheet being folded over upon itself to form a plurality of loops;

a trampoline mat comprising loops; and a cord passing through said apron loops and said trampoline mat loops to maintain said mat in relation to said support.

23. The bounce apparatus of claim 22, wherein said support is floatable.

* * * * *